US005647418A

United States Patent [19]

Ishizawa

[11] Patent Number: 5,647,418

[45] Date of Patent: Jul. 15, 1997

[54] DEBARKING TOOTH OF A DEBARKING MACHINE

[75] Inventor: Seiya Ishizawa, Shizuoka, Japan

[73] Assignee: Fuji Kogyo Co., Ltd., Shizuoka, Japan

[21] Appl. No.: 670,659

[22] Filed: Jun. 26, 1996

[30] Foreign Application Priority Data

Jul. 21, 1995 [JP] Japan ..... 7-207424

[51] Int. Cl.[6] ..... B27C 9/00

[52] U.S. Cl. ..... 144/208.9; 144/208.1; 144/241; 144/341

[58] Field of Search ..... 144/208.1, 208.9, 144/341, 241

[56] References Cited

U.S. PATENT DOCUMENTS 4,685,498 8/1987 Nakajima et al. ..... 144/341
4,691,750 9/1987 Nakajima ..... 144/341

FOREIGN PATENT DOCUMENTS 4-20761 4/1992 Japan .

*Primary Examiner*—W. Donald Bray
*Attorney, Agent, or Firm*—Whitham, Curtis, Whitham & McGinn

[57] ABSTRACT

A debarking tooth of a debarking machine comprises a platform secured to an outer surface of a rotary member rotatably arranged in a wood container; a blade tip plate detachably attached to the platform; an arbitrary number of engage projections formed on one of the platform and the blade tip plate in a tapered shape so that a horizontal area of each engage projection becomes gradually smaller toward a distal end; an arbitrary number of engage recesses formed on the other one of the platform and the blade tip plate in a tapered shape so that a horizontal area of each engage recess becomes gradually smaller toward a bottom, the engage recesses being respectively engageable with the engage projections; and a fixing screw member driven toward the platform from the blade tip plate with the engage projections engaged with the engage recesses, thereby securely attaching the blade tip plate to the platform.

20 Claims, 17 Drawing Sheets

DEBARKING TOOTH OF A DEBARKING MACHINE

BACKGROUND OF THE INVENTION

1. Field of the Invention

The present invention relates to the debarking tooth of a debarking machine for debarking the bark of trees and other bark covered growth, hereinafter referred to as "wood", and, more particularly, to an improvement of the attachment structure of a platform and a blade tip plate, which constitute a debarking tooth, in order to attach the blade tip plate to the platform more securely.

2. Description of the Related Art

An example of a debarking machine is disclosed in, for example, Examined Japanese Patent Publication No. Hei 4-20761. Each debarking tooth of the disclosed debarking machine has a structure as shown in FIGS. 21 to 23. The debarking tooth 201 comprises a platform 203 and a blade tip plate 205 which is securely joined to the platform 203 in a detachable manner. The platform 203 is secured to the outer surface of a rotary member 207. The rotary member 207 is rotatably positioned in a wood container (not shown) at the lower portion thereof. A engage projection 209 is protrusively provided at the joined surface of the platform 203 where the blade tip plate 205 is attached, as shown in FIG. 22. Formed in the joined surface of the blade tip plate 205 is an engage recess 211 which is to engage with the engage projection 209. The fitting allowance of the engage projection 209 with the engage recess 211 is set relatively large. This is because if the fitting allowance, is set too small, it may interfere with easy engagement of the projection 209 and the recess 211 with each other, thus making the assembling work difficult.

A plurality of tooth portions (four tooth portions in this case) 205*a* protrude from the upper portion of the blade tip plate 205 in FIG. 21. Those tooth portions 205*a* provide the desired debarking performance. A separate engage member 215 is securely welded to the rear one of both lengthwise ends of the platform 203 in the rotational direction of the rotary member 207. When the debarking tooth 201 is in use, a load acts toward the rear end of the platform 203 in the rotational direction of the rotary member 207 and this load is received by the engage member 215.

In securely attaching the thus constituted blade tip plate 205 to the platform 203, first, the engage projection 209 of the platform 203 is engaged with the engage recess 211 of the blade tip plate 205. This engagement is conducted mainly for the positioning purpose. Under this situation, fixing bolts 217 are fastened toward the platform 203 from the blade tip plate 205 at three sections. As a result, the blade tip plate 205 is securely attached to the platform 203.

A plurality of debarking teeth 201 with the above-described structure are attached to the outer surface of the rotary member 207 to debark the bark of loaded wood as the rotary member 207 rotates.

The blade tip plate 205 as shown in FIG. 21 is used for non-frozen wood. Further, various kinds of blade tip plates 205 whose tooth portions 205*a* have different shapes as shown in FIGS. 24A, 24B and 24C are used in accordance with the types of wood (hard wood and soft wood) and a change in the degree of wood's dryness or the like. The blade tip plate 205 as shown in FIG. 23 is used for frozen wood.

The above-described conventional structure has the following problems.

A large horizontal load (the load which acts from the direction perpendicular to the sheet surface in FIG. 20) acts on the three fixing bolts 217 which securely attach the blade tip plate 205 to the platform 203. This deteriorates the securing performance of the fixing bolts 217, and may thus loosen the attachment of the blade tip plate 205 to the platform 203 or may separate the blade tip plate 205 from the platform 203 in the worst case. This problem will be discussed more specifically. As already described, the blade tip plate 205 is designed to permit the engagement of the engage recess 211 with the engage projection 209 of the platform 203. This engagement structure is mainly for positioning of the blade tip plate 205 and the platform 203, but is not designed to receive the horizontal load. Therefore, a large horizontal load acts on the three fixing bolts 217.

To cope with the action of such a horizontal load, the diameter of the fixing bolt 217 may be increased or the number of the fixing bolts 217 may be increased. The width of the debarking tooth 201 is restricted, so that if the number of the fixing bolts 217 is increased under such restriction, the mechanical strength of the debarking tooth 201 itself is impaired. Likewise, the increase in the diameter of the fixing bolt 217 is limited from the view point of keeping the mechanical strength of the debarking tooth 201.

The aforementioned problem occurs even if the diameter of the fixing bolt 217 is increased or the number of the fixing bolts 217 is increased within the range where the mechanical strength of the debarking tooth 201 can be maintained.

Another possible problem is the penetration of a foreign matter between the blade tip plate 205 and the platform 203 (particularly between their joined surfaces), thus impairing the firm attachment of the blade tip plate 205 to the platform 203. As mentioned earlier, a certain degree of a fitting allowance (a certain degree of clearance) is given to the engage recess 211 of the blade tip plate 205 and the engage projection 209 of the platform 203. With such a slight clearance, a foreign matter may enter between the blade tip plate 205 and the platform 203 at the time of assembling them or while this debarking tooth 201 is in use. The penetrated foreign matter may deteriorate the firm attachment of the blade tip plate 205 to the platform 203.

SUMMARY OF THE INVENTION

Accordingly, it is an object of the present invention to provide a debarking tooth of a debarking machine which can ensure the firm attachment of the blade tip plate to the platform, is not easily loosened even when receiving a horizontal load when in use, and can prevent the penetration of foreign matter.

To achieve the above object, a debarking tooth of a debarking machine according to this invention comprises a platform secured to an outer surface of a rotary member rotatably arranged in a wood container; a blade tip plate detachably attached to the platform; an arbitrary number of engage projections formed on one of the platform and the blade tip plate in a tapered shape so that a horizontal area of each engage projection becomes gradually smaller toward a distal end; an arbitrary number of engage recesses formed on the other one of the platform and the blade tip plate in a tapered shape so that a horizontal area of each engage recess becomes gradually smaller toward a bottom, the engage recesses being respectively engageable with the engage projections; and a fixing screw member driven toward the platform from the blade tip plate with the engage projections engaged with the engage recesses, thereby securing attaching the blade tip plate to the platform.

Each engage projection may have a pair of outer side faces on both widthwise sides of the debarking tooth, at least one of the outer side faces having an inclined surface, and each engage recess may have a pair of inner side faces on both widthwise sides of the debarking tooth, at least one of the inner side faces having an inclined surface.

The pair of outer side faces of each engage projection may have inclined surfaces of the same inclination angle, and the pair of inner side faces of each engage recess may have inclined surfaces of the same inclination angle.

Each engage projection may further have a pair of outer side faces on both lengthwise sides of the debarking tooth, at least one of the outer side faces having an inclined surface, and each engage recess may further have a pair of inner side faces on both lengthwise sides of the debarking tooth, at least one of the inner side faces having an inclined surface.

The pair of lengthwise outer side faces of each engage projection may have inclined surfaces of the same inclination angle, and the pair of lengthwise inner side faces of each engage recess may have inclined surfaces of the same inclination angle.

The widthwise taper angles of the engage projections may be set greater than the widthwise taper angles of the engage recesses.

A foreign-matter penetration preventing engage recess may be formed in at least one of widthwise sides of each engage projection and a foreign-matter penetration preventing engage projection, which is engageable with the foreign-matter penetration preventing recess, may be formed on at least one of widthwise sides of each engage recess.

An engage section may be formed on the lengthwise rear end of the platform in the rotational direction of the rotary member so that an end of the blade tip plate is engaged with the engage section when the blade tip plate is securely attached to the platform.

Further, the platform and the blade tip plate may be formed by lost wax casting.

The debarking tooth of a debarking machine according to this invention employs an engagement structure having engage projections formed on one of the platform and the blade tip plate and engage recesses formed on the other one of the platform and blade tip plate in order to receive a horizontal load acting to the debarking tooth when in use. This reduces the horizontal load which acts on the fixing screw member, thus making the attachment of the blade tip plate to the platform firmer with respect to the horizontal load.

As the fixing screw member is driven with the engage projections engaged with the engage recesses, the engage projections and the engage recesses are fastened more firmly due to the difference in the taper angles of the engage projections and the engage recesses. The firmly attached structure receives the horizontal load acting when the debarking tooth is in use. As a result, the horizontal load acting on the fixing screw member is reduced and the overall horizontal load acting on the individual sections is reduced, thus ensuring the firm and secure attachment with a sufficient strength with respect to the horizontal load.

In short, according to the debarking tooth of a debarking machine which embodies this invention, the tapered engage projections are formed on the platform, the tapered engage recesses are formed on the other one of the platform and the blade tip plate, and the engage projections and the engage recesses are engaged with one another and are securely fastened by the fixing screw member, thus ensuring a firmer attachment of the blade tip plate to the platform.

If the taper angles of the engage recesses are made different from those of the engage projections, as the fixing screw member is driven, the attachment of the engage recesses with the engage projections becomes firmer. The firmly attached portions of the engage recesses and engage projections receives the horizontal load which acts when the debarking tooth is in use, and thus provides a structure with a sufficient strength with respect to the acting of the horizontal load when the debarking tooth is in use.

Because the engagement structure of the engage recesses with the engage projections can surely receive the horizontal load when the debarking tooth is in use, the horizontal load that acts on the fixing screw member is reduced significantly, thus preventing the concentration of the horizontal load only on the fixing screw member which would occur in the prior art. Further, the horizontal load when the debarking tooth is in use can be distributed to the engagement structure of the engage recesses and the engage projections and a plurality of fixing screw members. This prevents the local concentration of the horizontal load, thus providing a firmer support structure.

When the blade tip plate and the platform are fastened by the fixing screw member, there is no clearance between the engage recesses and the engage projections. Even if a horizontal load acts when the debarking tooth is in use, therefore, the engage recesses will not unintentionally shift from the associated engage projections. Thus, there is no frictional wearing which may otherwise be caused by such shifting.

In the case where a foreign-matter penetration preventing engage projection is formed on one of the platform and the blade tip plate and a foreign-matter penetration preventing engage recess is formed on the other one of the platform and the blade tip plate, it is possible to effectively prevent the penetration of a foreign matter between the platform and the blade tip plate. The prevention of the penetration of a foreign matter can allow the firm attachment of the platform to the blade tip plate to be surely maintained.

Because the engage recesses of the platform and the engage projections of the blade tip plate are tapered, those recesses and projections can easily be engaged with one another at the time of assembling the debarking tooth, thus making the assembling work easier.

If the platform and the blade tip plate are formed by lost wax casting, it is possible to easily form complicated shapes.

DETAILED DESCRIPTION OF THE PREFERRED EMBODIMENTS

The first embodiment of the present invention will now be described referring to FIGS. 1 through 17.

Figure 1:
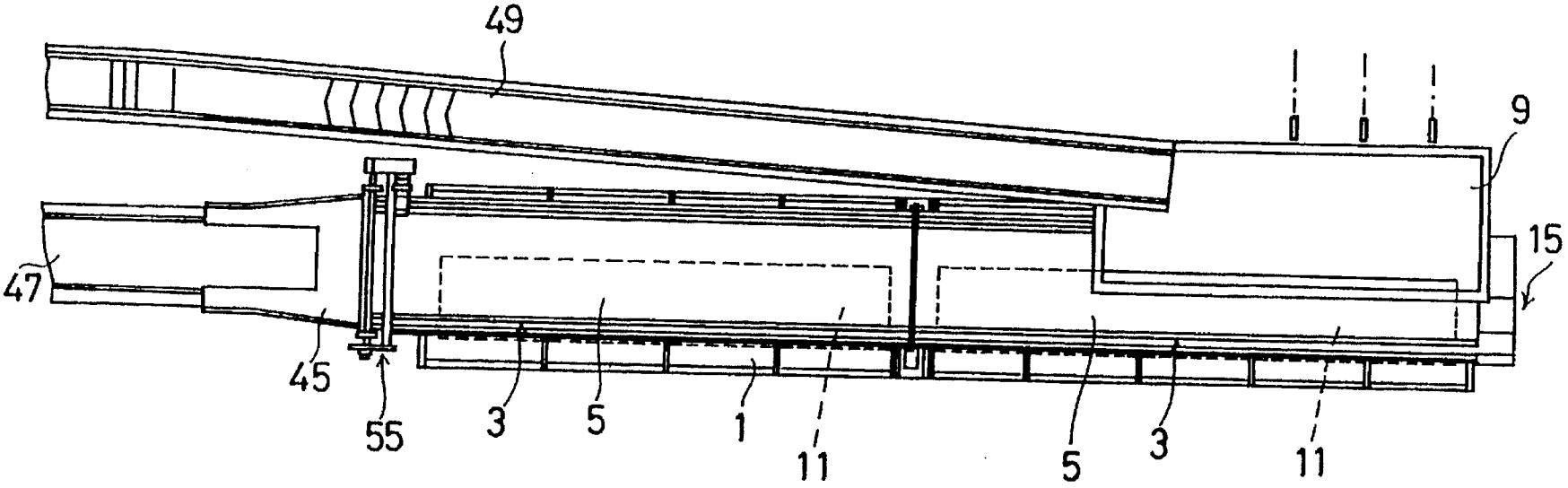
FIG. 1 is a top view of the general structure of a debarking machine showing the first embodiment of this invention.
Figure 2:
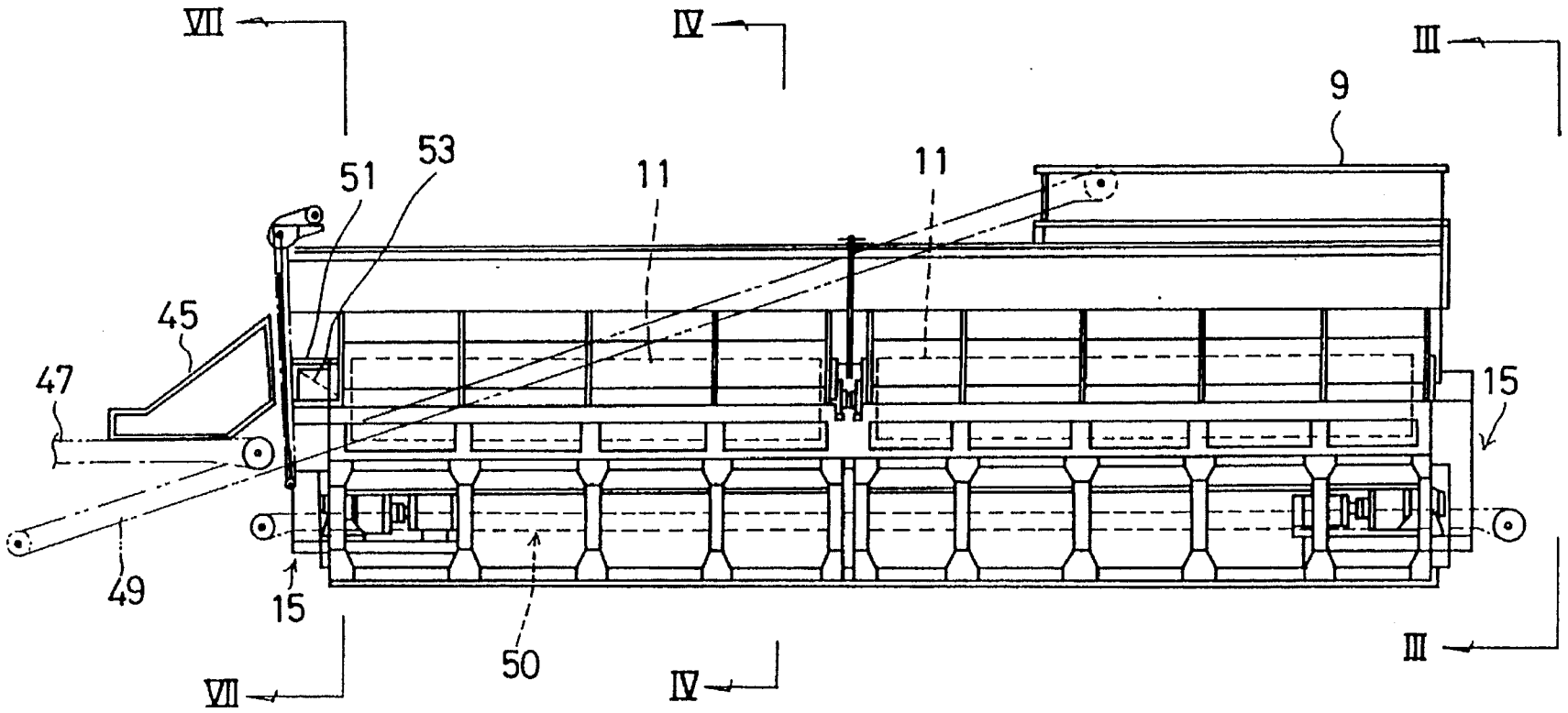
FIG. 2 is a front view of the structure of a debarking machine showing the first embodiment of this invention.

To begin with, the general structure of a debarking machine equipped with a debarking tooth embodying this invention will now be discussed with reference to FIGS. 1 through 9. As shown in FIG. 1, two debarking units 3 coupled in series are placed on a base 1. The debarking units 3 respectively have wood containers 5, 5 which are connected longitudinally in alignment, inclining downward toward the wood feeding side (leftward in FIGS. 1 and 2). Openings 7 are formed in the lower portions of the respective wood containers 5 over the entire lengths thereof, as shown in FIG. 4. As shown in FIGS. 1 and 2, a wood supplying hopper 9 is provided on the upstream side toward the wood feeding side. An unillustrated wood supplying lifter (or wood supplying conveying mechanism) is provided to permit the supply of wood to be debarked into the wood container 5 of the debarking unit 3, shown on the right side in FIGS. 1 and 2, via the wood supplying hopper 9.

Figure 4:
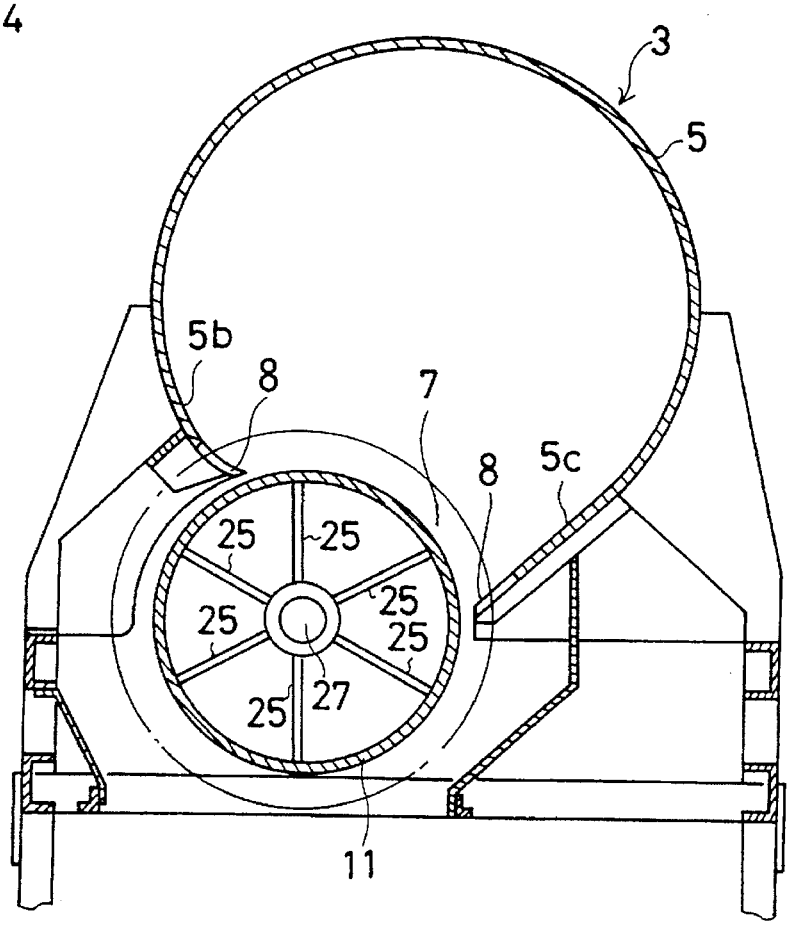
FIG. 4 is a cross-sectional view of the first embodiment of this invention along the line IV—IV in FIG. 2.
Figure 5:
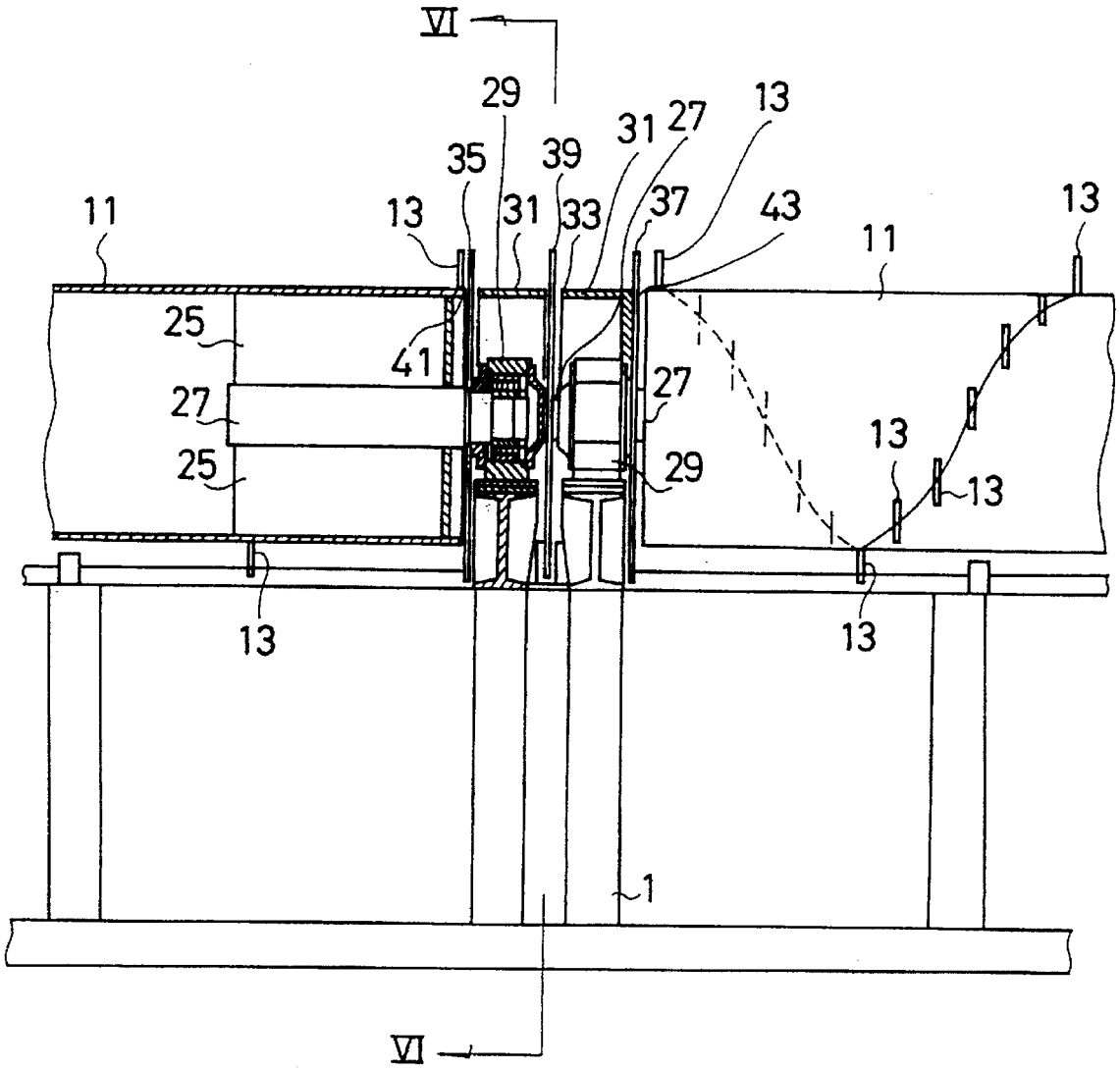
FIG. 5 is a partly cutaway front view of the rotational support structure of the opposing sides of a pair of rotary members depicting the first embodiment of this invention.

Each opening is formed at the position shifted sideways from the center of the respective wood container 5 (leftward in FIG. 4 which is on the opposite side to the wood supplying hopper 9), as shown in FIG. 4. Rotary members 11, 11 are arranged in a rotatable manner under the associated openings 7, 7. Each rotary member 7 has a drum shape with its top end portion protruding into the associated wood container 5. A plurality of debarking teeth 13 are attached in a spiral form on the outer surface of each rotary member 11, as shown in FIG. 5. As shown in FIG. 4, slits 8 where those debarking teeth 13 are respectively formed at lower portions 5*b* and 5*c* of each wood container 5. In other words, the lower portions 5*b* and 5*c* of the wood container 5 are designed as a so-called "comb shape."

The structure of the debarking tooth 13 will be described in detail later.

Figure 3:
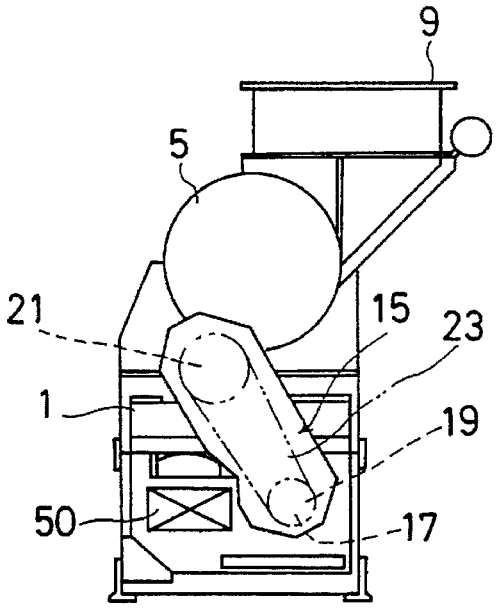
FIG. 3 is a perspective view of the first embodiment of this invention along the line III—III in FIG. 2.

As shown in FIGS. 1, 2 and 3, a rotary driving mechanism 15 for rotating the rotary member 11 is provided at the right end (in the diagrams) of the debarking unit 3 which is located at the upstream side (right side in FIGS. 1 and 2) toward the wood supplying side. As shown in FIG. 3, a sprocket 19 is secured to the output shaft of a drive motor 17. Provided at a predetermined location apart from the sprocket 19 is another sprocket 21 which is coaxially secured to the rotary member 11. A chain 23 is put around the sprockets 19 and 21. As the drive motor 17 rotates, the rotation is transmitted to the rotary member of the right debarking unit 3 shown in FIGS. 1 and 2 via the sprocket 19, the chain 23 and the sprocket 21.

The left debarking unit 3 shown in FIGS. 1 and 2 is rotated by another rotary driving mechanism 15 with the same structure, and this driving mechanism 15 is provided on the left side of the rotary member 11 in FIGS. 1 and 2.

Figure 6:
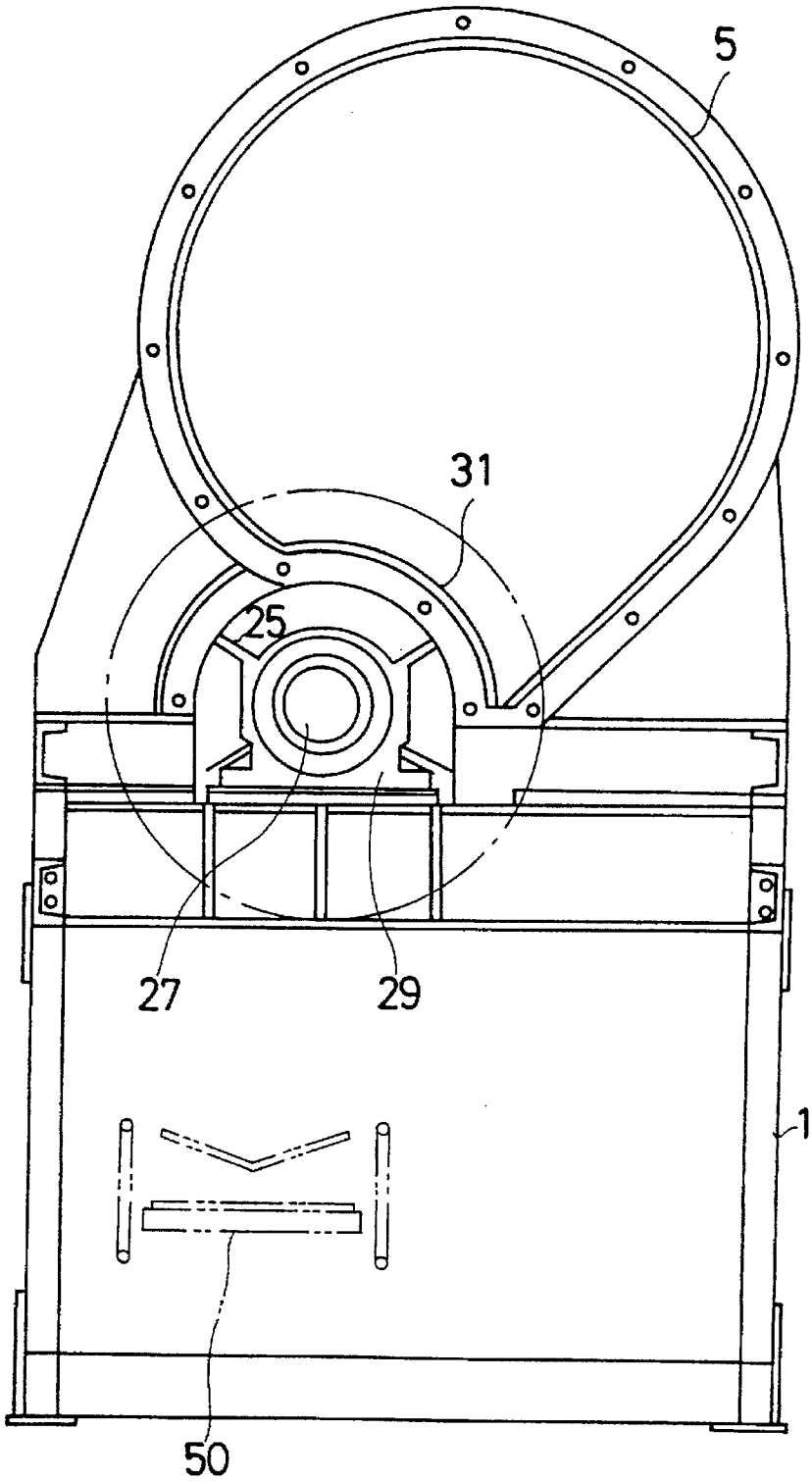
FIG. 6 is a cross-sectional view of the first embodiment of this invention along the line VI—VI in FIG. 5.

The support structure of the end portion on the side where the rotary members 11, 11 face each other will be described with reference to FIGS. 4, 5 and 6. With regard to the end portion of the rotary member located on the left side in FIG. 5 (the right end in the diagram), a plurality of rectangular plates 25 are formed on the inner side of the end portion of the rotary member 11, extending in the radial directions (see FIG. 4), and a shaft portion 27 is secured to the center position of those plate 25. This shaft portion 27 is rotatably supported by a bearing member 29 which is supported on the base 1. The same structure is taken on the rotary member 11 located on the right side in FIG. 5, and a shaft portion 27 protruding leftward in the diagram is rotatably supported by another bearing member 29.

On this side, however, the end of the shaft portion 27 protrudes farther leftward in the diagram than the bearing member 29.

A cover 31 has an arcuate shape which is flush with the rotary members 11, 11. A slit 33 is formed in substantially the center position of this cover 31. Debarking disks 35 and 37 are respectively secured to the shaft portions 27 between the rotary members 11, 11 and the cover 31. Another debarking disk 39 is likewise secured to the end of the shaft portion 27 of the rotary member 11 which is located on the right side in FIG. 5. This debarking disk 39 protrudes outward through the slit 33 of the cover 31. The debarking disks 35 and 37 protrude outward through gaps 41 and 43 between the rotary members 11, 11 and the cover 31. Debarking teeth which are the same as the above-described debarking teeth 13 are attached to the outer surface of each of those debarking disks 35, 37 and 39. The provision of those rotational disks 35, 37 and 39 permits the feeding of wood from the rotary member 11 located on the right side in FIG. 5 to the rotary member 11 located on the left side in the diagram, and ensures the debarking performance while the device is feeding the wood.

The structure on the left side (in FIG. 2) of the rotary member 11 located on the left side in FIG. 2, i.e., the structure on the discharge side where debarked wood is to be discharged will be discussed below with reference to FIG. 7.

First, a wood discharge port 5a is formed in the end of the wood container 5, and a wood discharging chute 45 shown in FIGS. 1 and 2 is coupled to the outside of this wood discharge port 5a. Debarked wood which is discharged via the wood discharge port 5a and wood discharging chute 45 is discharged onto a wood discharging conveyor mechanism 47 to be sorted out. When some wood has its bark left undebarked, this wood is sent to a return conveyor mechanism 49 through which it is supplied again into the wood supplying hopper 9. As shown in FIGS. 2 and 3, a bark discharging conveyor mechanism 50 for discharging the received, debarked bark is provided under the base 1.

Figure 7:
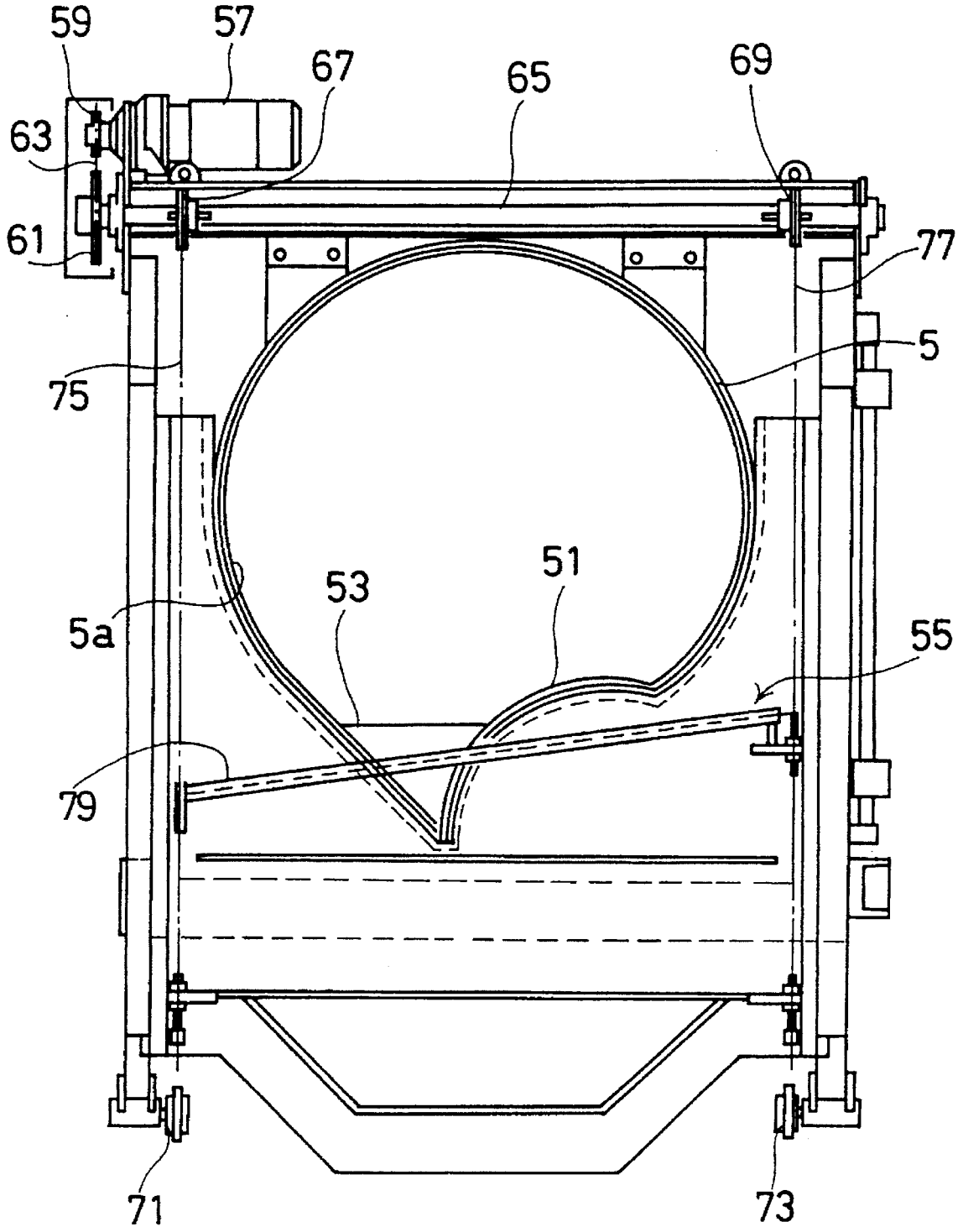
FIG. 7 is a cross-sectional view of the first embodiment of this invention along the line VII—VII in FIG. 2.
Figure 8:
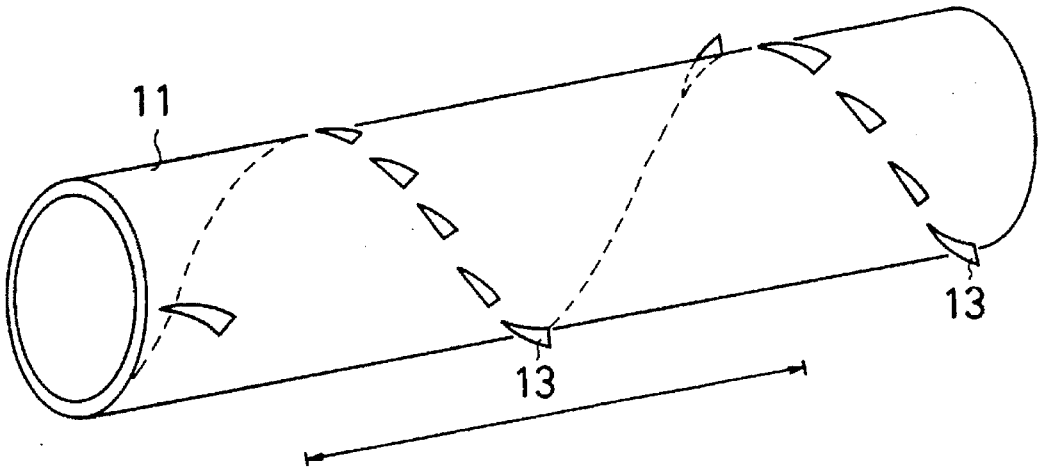
FIG. 8 is a perspective view of the first embodiment of this invention illustrating the outer surface of the rotary member.
Figure 9:
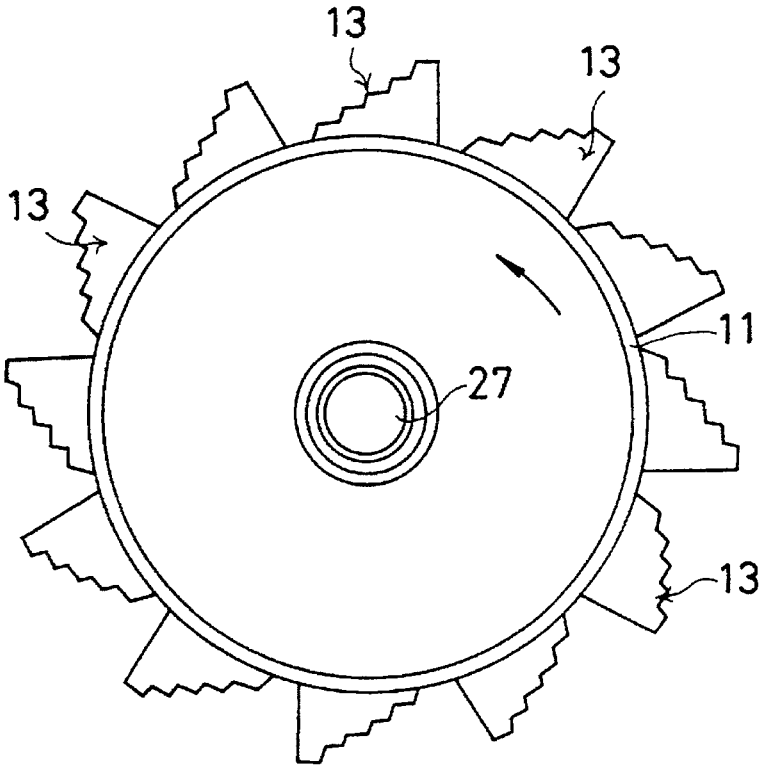
FIG. 9 is a side view of the first embodiment of this invention illustrating the outer surface of the rotary member.

A cover 51 is provided in front of the wood discharge port 5a, as shown in FIGS. 1 and 7. This cover 51 has approximately the same shape as the above-described cover 31. A guide plate 53, which is securely welded to the cover 51, allows debarked wood to be smoothly discharged through the wood discharge port 5a.

As shown in FIGS. 1 and 7, a shutter mechanism 55 is provided at the position of the wood discharge port 5a. A sprocket 59 is secured to the output shaft of a drive motor 57. Provided below this sprocket 59 is another sprocket 61. A chain 63 is put around those sprockets 59 and 61. The sprocket 61 is secured to one end of a shaft member 65 to which separate sprockets 67 and 69 are secured apart from each other at such positions as to sandwich the wood container 5. Sprockets 71 and 73 are respectively arranged under the sprockets 67 and 69 in the diagrams. A chain 75 is put around the sprockets 67 and 71. Both ends of a shutter member 79 are fixed to the chains 75 and 77. As the drive motor 57 rotates, therefore, the shutter member 79 can be elevated up or down properly. To make the wood debarking time longer, the shutter member 79 should be move upward to expose the wood discharge port 5a for the restriction of the discharging of wood.

Figure 10:
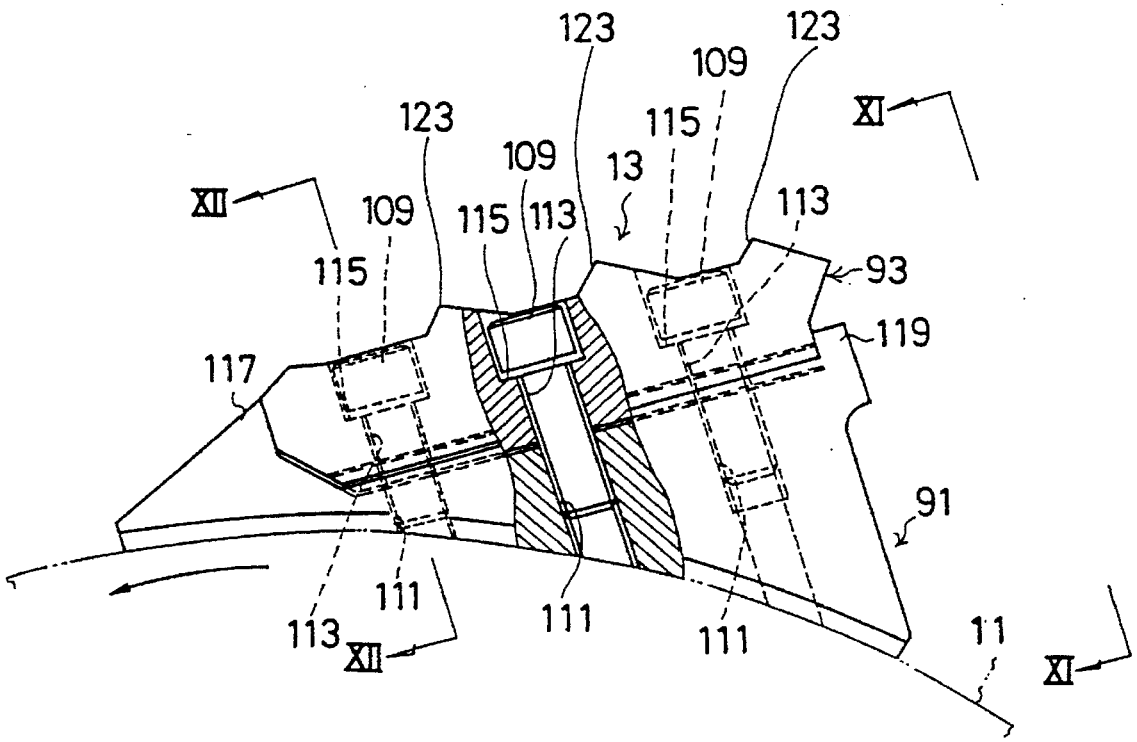
FIG. 10 is a partly cutaway front view of the structure of a debarking tooth showing the first embodiment of this invention.
Figure 11:
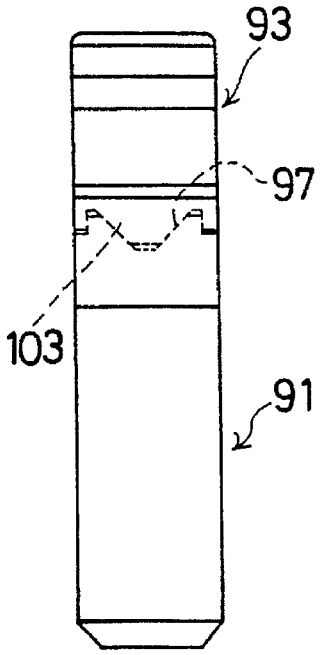
FIG. 11 is a perspective view of the first embodiment of this invention along the line XI—XI in FIG. 10.
Figure 12:
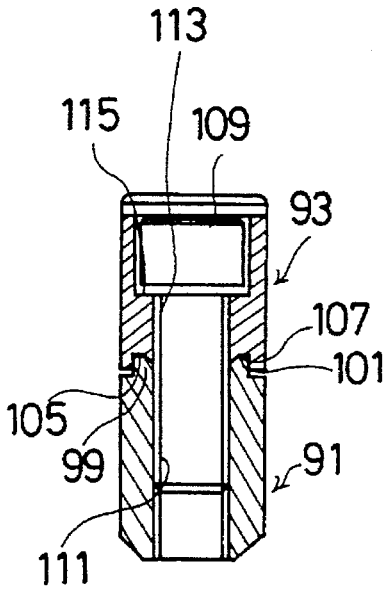
FIG. 12 is a cross-sectional view of the first embodiment of this invention along the line XII—XII in FIG. 11.
Figure 13:
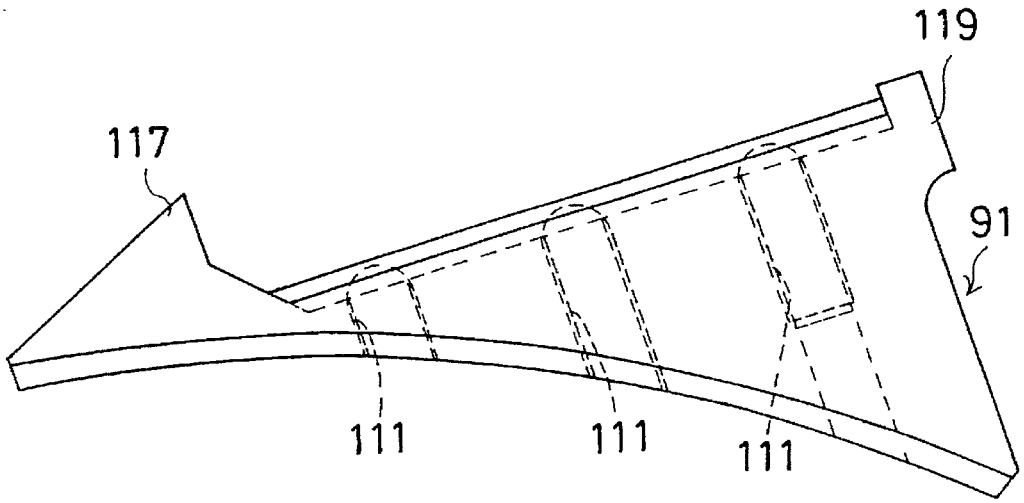
FIG. 13 is a front view of a platform showing the first embodiment of this invention.
Figure 14:
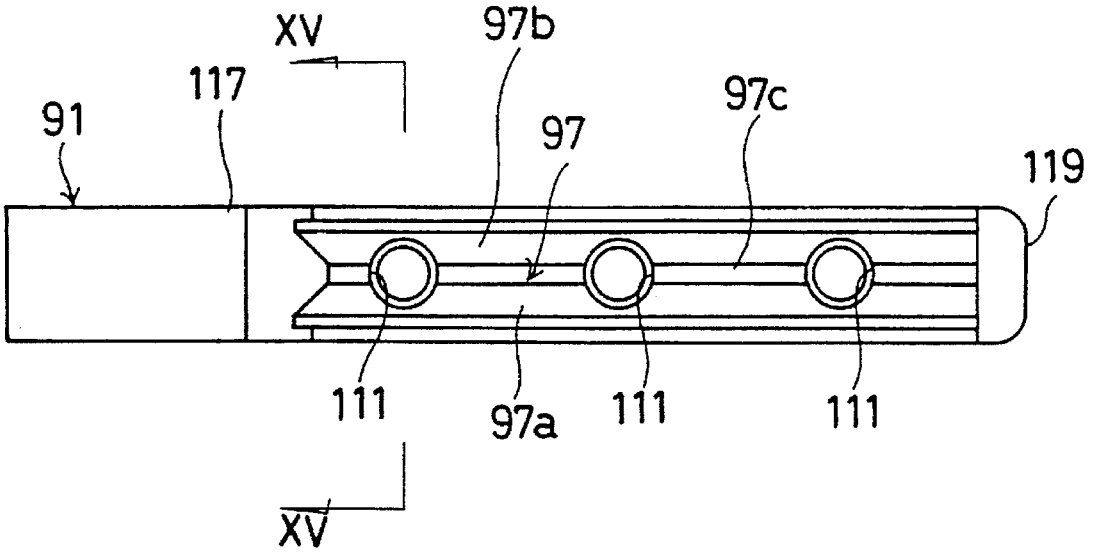
FIG. 14 is a top view of the platform showing the first embodiment of this invention.
Figure 15:
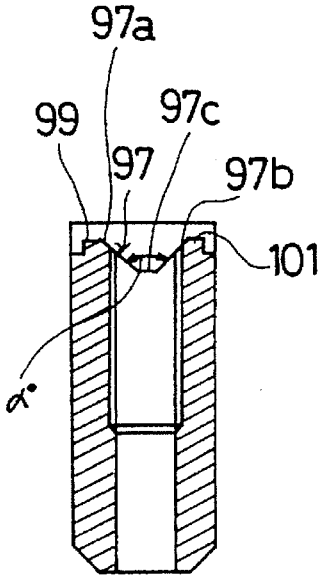
FIG. 15 is a cross-sectional view of the first embodiment of this invention along the line XV—XV in FIG. 14.
Figure 16:
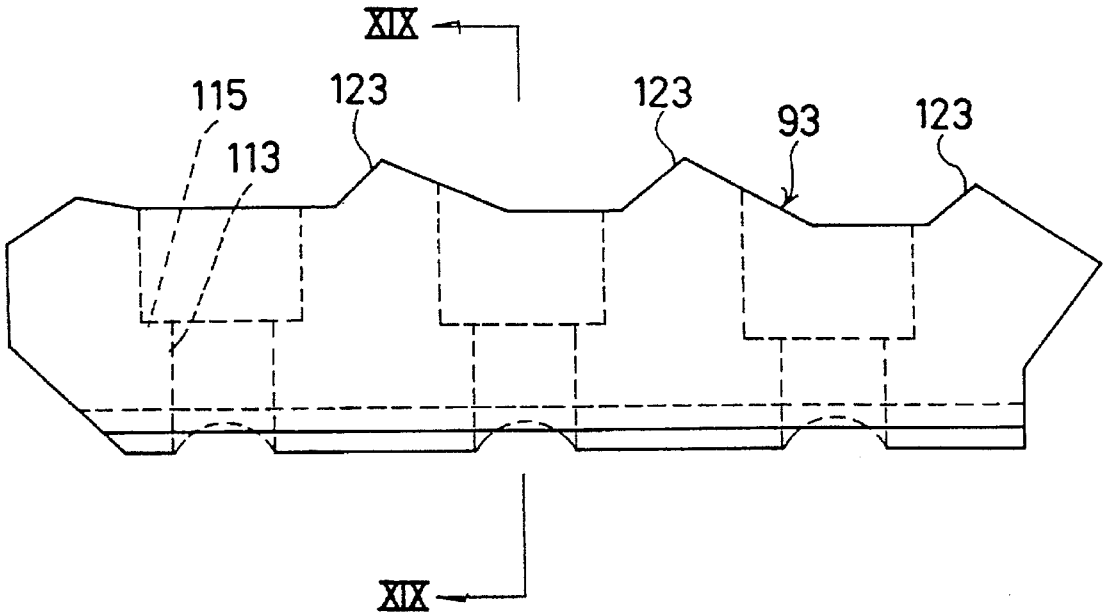
FIG. 16 is a front view of the structure of a blade tip plate showing the first embodiment of this invention.

The structure of the debarking tooth 13 itself will now be described in detail referring to FIGS. 10 through 18. As shown in FIG. 10, first, the debarking tooth 13 comprises a platform 91 and a blade tip plate 93 which is securely fixed to this platform 91 in a detachable manner. The platform 91 is secured to the outer surface of the rotary member 11. An engage recess 97 is formed in the joined surface of the platform 91 where the blade tip plate 93 is securely attached. This engage recess 97 is tapered in such a way that the width gradually becomes narrower downward (toward the rotary member 11) and has two inclined surfaces 97a and 97b extending in the lengthwise direction and a bottom surface 97c, as shown in FIGS. 11 through 15 (particularly in FIG. 15). The engage recess 97 extends to a relatively deep position. Foreign-matter penetration preventing engage projections 99 and 101 are formed on both widthwise sides of the engage recess 97, respectively.

Figure 17:
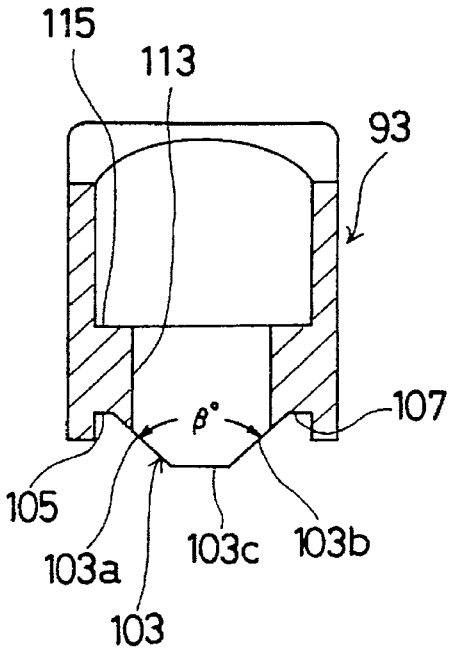
FIG. 17 is a cross-sectional view of the first embodiment of this invention along the line XVII—XVII in FIG. 16.
Figure 18:
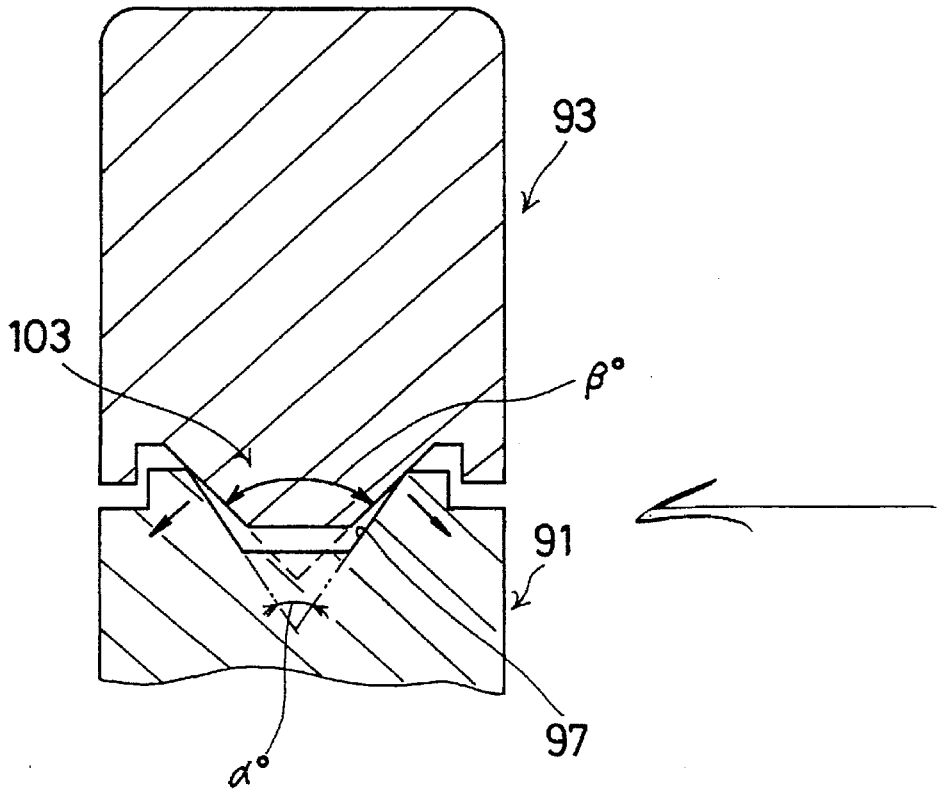
FIG. 18 is a cross-sectional view of the engagement structure of engage recesses and engage projections illustrating the first embodiment of this invention.

An engage projection 103 which is to engage with the engage recess 97 is formed on the joined surface of the blade tip plate 93 with respect to the platform 91. As shown in FIG. 17, this engage projection 103 is tapered in such a way that the width gradually becomes narrower toward the platform 91 and has two inclined surfaces 103a and 103b extending in the lengthwise direction and a distal end surface 103c. Foreign-matter penetration preventing engage recesses 105 and 107 are respectively formed on both widthwise sides of the engage projection 103. The engage projection 103 engages with the engage recess 97 of the platform 91, and the foreign-matter penetration preventing engage recesses 105 and 107 respectively engage with the foreign-matter penetration preventing engage projections 99 and 101 of the platform 91.

A description will now be given of the taper angles of the engage recess 97 of the platform 91 and the engage projection 103 of the blade tip plate 93. Given that the taper angle of the engage recess 97 is $\alpha°$ (shown in FIG. 15) and the taper angle of the engage projection 103 is $\beta°$ (shown in FIG. 17), the following equation I is satisfied.

$$\alpha° < \beta° \quad \text{(I)}$$

That is, the taper angle $\beta°$ of the engage projection 103 is set greater than the taper angle $\alpha°$ of the engage recess 97 (more specifically, there is an angle difference of about 0.01° or 0.02°). The purpose of this angle difference will be discussed later.

Female screw portions 111 where fixing bolts 109 are fastened are formed at three portions of the platform 91. Through holes 113 in which the fixing bolts 109 are fitted are formed in the blade tip plate 93, with step portions 115 formed at the upper portions of the through holes 113.

To securely fix the blade tip plate 93 to the platform 91, first, the engage projection 103 of the blade tip plate 93 is engaged with the engage recess 97 of the platform 91. At this time, the foreign-matter penetration preventing engage recesses 105 and 107 are also engaged with the foreign-matter penetration preventing engage projections 99 and 101, respectively. At this time, the upper ends of the inclined surfaces 97a and 97b of the engage recess 97 abut the respective inclined surfaces 103a and 103b of the engage projection 103 due to the difference between the taper angles of the engage recess 97 and the engage projection 103. With those engagements established, the three fixing bolts 109 are inserted into the associated through holes 113 to be fastened into the female screw portions 111. At this time, as the fixing bolts 109 are fastened, the fastening becomes firmer because of the taper angle $\beta°$ of the engage projection 103 set greater than the taper angle $\alpha°$ of the engage recess 97, as mentioned above. In other words, as the fixing bolts 109 are gradually fastened, the inclined surfaces 97a and 97b of the engage recess 97 are pressed wider in the directions indicated by the arrows in FIG. 18, so that the attachment of the inclined surfaces 103a and 103b of the engage projection 103 with the inclined surfaces 97a and 97b of the engage recess 97 becomes firmer. This can ensure a firmer attachment.

An engage section 119 is formed at the lengthwise rear end of the platform 91 in the rotational direction of the rotary member 11, so that when the blade tip plate 93 is securely attached to the platform 91, the end of the blade tip plate 93 is engaged with the inner side face of the engage section 119. This engagement can cope with the load which acts toward the rear end in the rotational direction of the rotary member 11 when the debarking tooth 13 is in use. A plurality of tooth portions 123 (three tooth portions in this case) are formed at the distal end face of the blade tip plate 93.

A description will now be given of a method of manufacturing the platform 91 and the blade tip plate 93, which are structured as described above. According to this embodiment, the platform 91 and the blade tip plate 93 are formed by so-called "lost wax casting." This lost wax casting can ensure easy formation of articles with relatively complex shapes, so that the platform 91 and the blade tip plate 93, which have relatively complex shapes, can easily cast and formed according to this embodiment.

This embodiment has the following advantages.

The tapered engage recess 97 provided in the platform 91 and the tapered engage projection 103 provided on the blade tip plate 93 are engaged with each other, and are securely fastened by the fixing bolts 109, at which time as the fixing bolts 109 are fastened, the attachment of the engage recess 97 with the engage projection 103 becomes firmer due to the difference between the taper angles of the engage recess 97 and the engage projection 103. The attached portions of those engage recess 97 and engage projection 103 receive the horizontal load when the debarking tooth 13 is in use, thus ensuring the structure which has a sufficient strength with respect to the horizontal load when the debarking tooth 13 is in use.

According to this embodiment, the taper angle of the engage recess 97 differs from that of the engage projection 103. Even when their taper angles are set equal to each other, the inclined surfaces are firmly attached together so that the horizontal load can be coped with, as long as the recess 97 and the projection 103 are processed at a high precision.

As the engagement structure of the engage recess 97 and the engage projection 103 can surely receive the horizontal load when the debarking tooth 13 is in use, the horizontal load acting on the fixing bolts 109 can be reduced significantly. Unlike in the prior art, therefore, it is possible to prevent the horizontal load from concentrating only on the fixing bolts 109. The horizontal load acting when the debarking tooth 13 is in use can be distributed by the engagement structure of the engage recess 97 and the engage projection 103 and the three fixing bolts 109, thus preventing the local concentration of the horizontal load and ensuring a stronger support mechanism as a whole.

With the fixing bolts 109 fastened to secure the engagement of the engage recess 97 with the engage projection 103, there is no clearance formed between the engage recess 97 and the engage projection 103. Even if the horizontal load acts on the debarking tooth 13 when in use, therefore, the engage recess 97 and the engage projection 103 will not be shifted unintentionally. This can eliminate the occurrence of frictional wearing which may otherwise be caused by such shifting.

Further, the engagement structure of the foreign-matter penetration preventing engage projections 99 and 101 of the platform 91 with the foreign-matter penetration preventing engage recesses 105 and 107 of the blade tip plate 93 can effectively prevent the penetration of a foreign matter between the platform 91 and the blade tip plate 93. The prevention of the penetration of a foreign matter can allow the firm attachment of the blade tip plate 93 to the platform 91 to be surely maintained.

As the engage recess 97 of the platform 91 and the engage projection 103 of the blade tip plate 93 are tapered, both can easily engage with each other at the time of assembling the debarking tooth 13, thus ensuring an easier assembling work.

Figure 19:
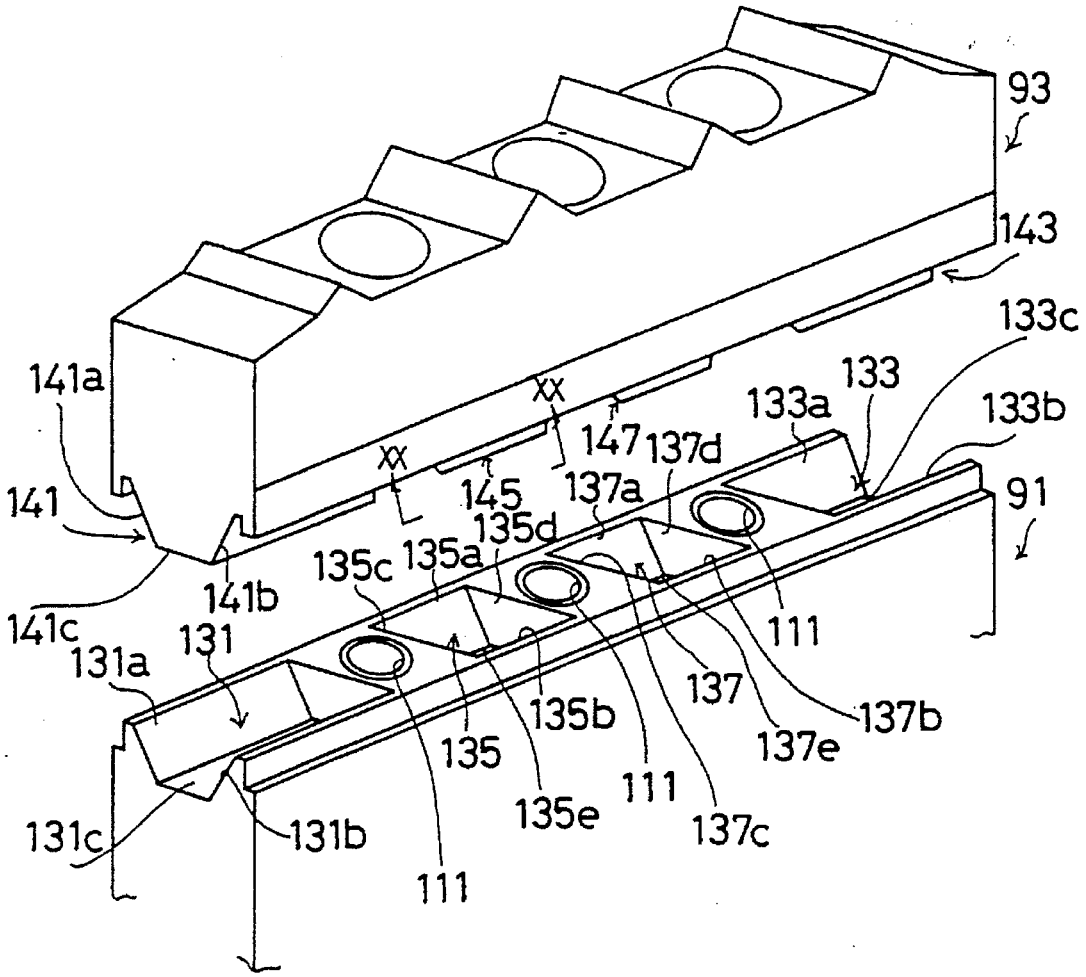
FIG. 19 is an exploded perspective view of a platform and a blade tip plate according to the second embodiment of this invention.
Figure 20:
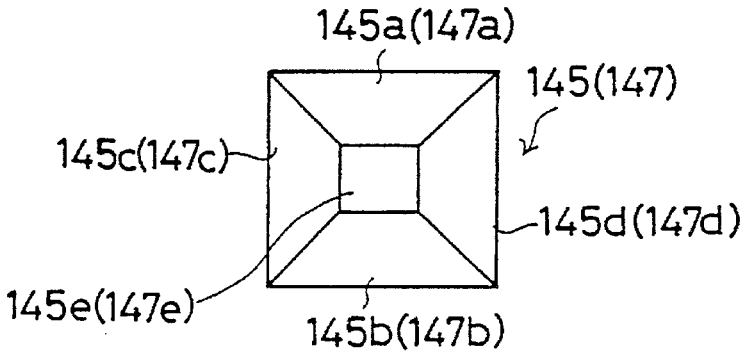
FIG. 20 is a perspective view of the first embodiment of this invention along the line XX—XX in FIG. 19.
Figure 21:
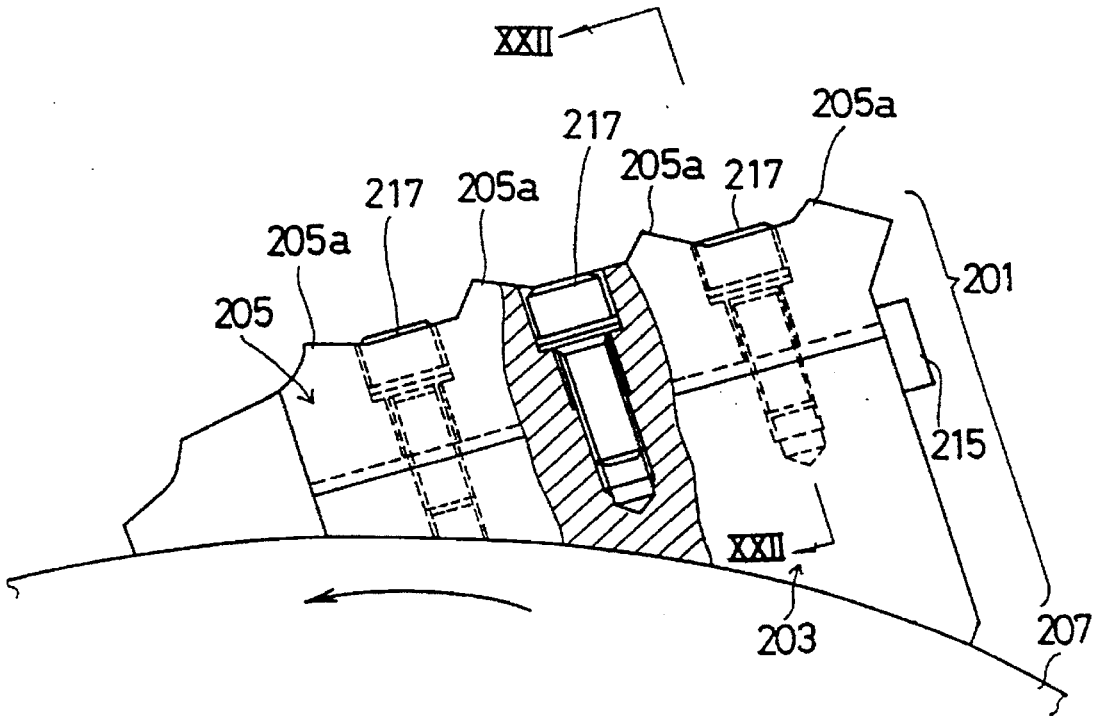
FIG. 21 (PRIOR ART)
FIG. 21 is a partly cutaway front view of the structure of a debarking tooth according to prior art.
Figure 22:
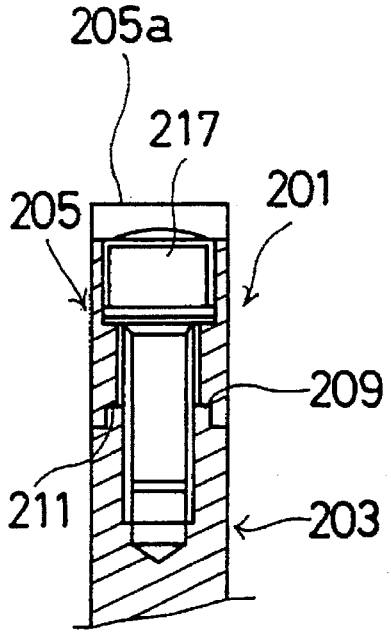
FIG. 22 (PRIOR ART)
FIG. 22 is a cross-sectional view of the prior art along the line XXII—XXII in FIG. 21.
Figure 23:
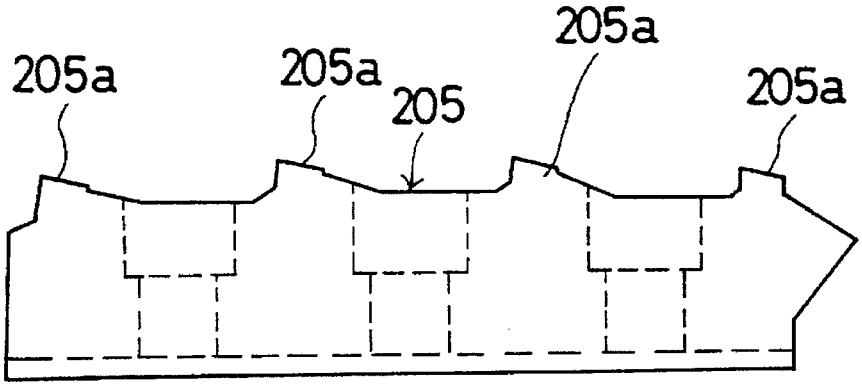
FIG. 23 (PRIOR ART)
FIG. 23 is a front view of the structure of a blade tip plate according to prior art.
Figure 24A:
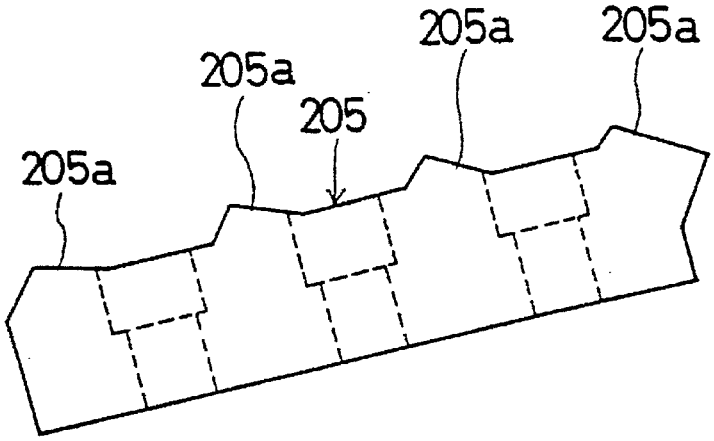
FIG.24 A (PRIOR ART)
FIGS. 24A, 24B and 24C are front views showing the structures of blade tip plates according to prior art.
Figure 24B:
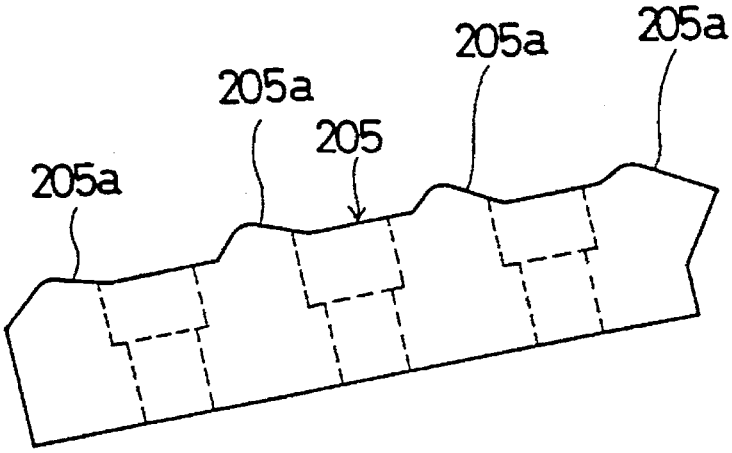
FIG.24B (PRIOR ART)
Figure 24C:
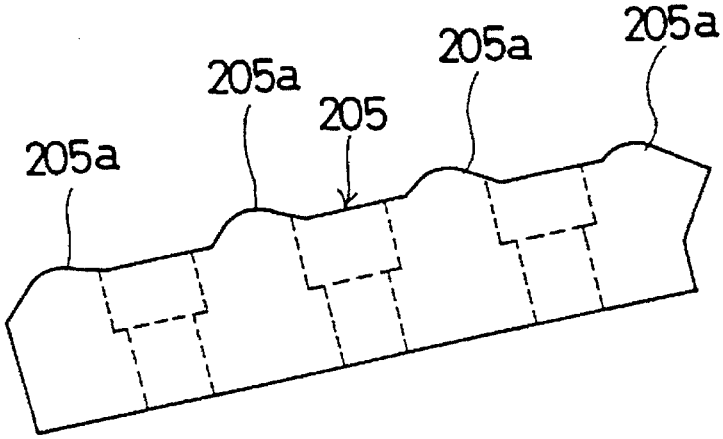
FIG.24C (PRIOR ART)

The second embodiment of this invention will now be described with reference to FIGS. 19 and 20.

Like or same reference numerals as used for the first embodiment will also be used to denote the corresponding or identical components of the second embodiment to avoid repeating their descriptions.

Engage recesses 131 and 133 are formed in both lengthwise ends of the platform 91, and those engage recesses 131 and 133 correspond to a part of the engage recess 97 which has been discussed in the foregoing description of the first embodiment. The engage recess 131 has inclined surfaces 131*a* and 131*b* and a bottom surface 131*c*, and the engage recess 133 has inclined surfaces 133*a* and 133*b* and a bottom surface 133*c*.

Separate engage recesses 135 and 137 are formed between the engage recesses 131 and 133. Those engage recesses 135 and 137 are shaped like recessed pyramids. The engage recess 135 has inclined surfaces 135*a*, 135*b*, 135*c* and 135*d*, and a bottom surface 135*e*. The engage recess 137 has inclined surfaces 137*a*, 137*b*, 137*c* and 137*d*, and a bottom surface 137*e*.

Engage projections 141 and 143 are formed on both lengthwise ends of the blade tip plate 93, and those engage projections 141 and 143 are shaped like a part of the above-described engage projection 103 of the first embodiment. The engage projection 141 has inclined surfaces 141*a* and 141*b* and a distal end surface 141*c*. The engage projection 143 has inclined surfaces 143*a* and 143*b* and a bottom surface 143*c*.

Separate engage projections 145 and 147 are formed between the engage projections 141 and 143. Those engage projections 145 and 147 are shaped like protruding pyramids, as shown in FIG. 20. The engage projection 145 has inclined surfaces 145*a*, 145*b*, 145*c* and 145*d*, and a bottom surface 145*e*. The engage projection 147 has inclined surfaces 147*a*, 147*b*, 147*c* and 147*d*, and a bottom surface 147*e*.

The widthwise taper angle of each engage recess is set different from that of each associated engage projection in the second embodiment as per the first embodiment. In this case, the engage recess and the engage projection are separated in the lengthwise direction, thus providing several engagement surfaces in the lengthwise direction which can cope with the load that acts toward the rear end in the rotational direction of the rotary member 11. In other words, the engage section 119 alone copes with the load that acting toward the rear end in the rotational direction of the rotary member 11 in the first embodiment, whereas the three engagement surfaces exhibit the same performance in the second embodiment, thus providing a firmer support structure.

This invention is not limited to those two embodiments. The other structure of the debarking machine including the rotary member 11 to which the debarking tooth 13 is attached is not particularly limited to the illustrated structure, which is to be considered as illustrative and not restrictive.

Although the engage recess 97 is formed in the platform 91 and the engage projection 103 is formed on the blade tip plate 93 in those embodiments, the engage projection 103 may be formed on the platform 91 and the engage recess 97 may be formed in the blade tip plate 93. In this case, the locations of the foreign-matter penetration preventing engage projections 99 and 101 and the locations of the foreign-matter penetration preventing engage recesses 105 and 107 are reversed.

Although a single engage projection 103 and a single engage recess 97 are provided in the first embodiment, the numbers of the engage projections and the engage recesses may be set to two or greater, or each of the engage projection and engage recess may be separated into a plurality of sections as in the second embodiment.

With regard to the shapes of the engage recess and engage projection, which one of a pair of widthwise side faces should be an inclined surface and which one of a pair of lengthwise side faces should be an inclined surface may be set arbitrarily.

The type and the number of the fixing bolts 109 or the fixing screw members are not limited to those illustrated.

The structures of the other components may be properly modified without departing from the spirit or scope of the invention.

What is claimed is:

1. A debarking tooth of a debarking machine for use with a container, comprising:

a platform secured to an outer surface of a rotary member rotatably arranged in the container;

a blade tip plate detachably attached to said platform;

at least one engagement projection formed on one of said platform and said blade tip plate, said at least one engagement projection having a tapered shape so that a horizontal area of said at least one engagement projection becomes gradually smaller in a first direction;

at least one engagement recess formed on the other one of said platform and said blade tip plate, said at least one engagement recess having a tapered shape so that a horizontal area of said at least one engagement recess becomes gradually smaller in a second direction, said at least one engagement recess being engageable with said at least one engagement projection; and a fixing screw member for connecting said platform and said blade tip plate such that said at least one engagement projection engages said at least one engagement recess, thereby securely attaching said blade tip plate to said platform.

2. A debarking tooth as claimed in claim 1, wherein said at least one engagement projection has a first pair of outer side faces on first and second sides of said debarking tooth, at least one outer side face of said first pair outer side faces having an inclined surface, and said at least one engagement recess having a first pair of inner side faces on said first and second sides of said debarking tooth, at least one inner side face of said first pair of inner side faces having an inclined surface.

3. A debarking tooth as claimed in claim 2, wherein said first pair of outer side faces of said at least one engagement projection have inclined surfaces forming a first inclination angle, and said first pair of inner side faces of said at least one engagement recess have inclined surfaces forming a second inclination angle, wherein said first inclination angle is the same as said second inclination angle.

4. A debarking tooth as claimed in claim 2, wherein said at least one engagement projection further has a second pair of outer side faces on third and fourth sides of said debarking tooth, at least one outer side face of said second outer side faces having an inclined surface, and said at least one engagement recess further having a pair of second inner side faces on said third and fourth sides of said debarking tooth, at least one inner side face of said second inner side faces having an inclined surface.

5. A debarking tooth as claimed in claim 4, wherein said second pair of outer side faces of said at least one engagement projection have inclined surfaces forming a first inclination angle, and said second pair of inner side faces of said at least one engagement recess have inclined surfaces forming a second inclination angle, wherein said first inclination angle is the same as said second inclination angle.

6. A debarking tooth as claimed in claim 1, wherein a taper angle of said at least one engagement projection is set greater than a taper angle of said at least one engagement recess.

7. A debarking tooth as claimed in claim 1, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

8. A debarking tooth as claimed in claim 1, wherein said platform includes an engagement section positioned on a first end of said platform in a rotational direction of said rotary member so that an end of said blade tip plate engages said engagement section when said blade tip plate is attached to said platform.

9. A debarking tooth of a debarking machine for use with a container, comprising:

a platform secured to an outer surface of a rotary member rotatably arranged in the container;

a blade tip plate detachably attached to said platform, said platform and said blade tip plate being formed by lost wax casting, at least one engagement projection formed on one of said platform and said blade tip plate, said at least one engagement projection having a tapered shape so that a horizontal area of said at least one engagement projection becomes gradually smaller in a first direction; and at least one engagement recess formed on the other one of said platform and said blade tip plate, said at least one engagement recess having a tapered shape so that a horizontal area of said at least one engagement recess becomes gradually smaller in a second direction, said at least one engagement recess being engageable with said at least one engagement projection.

10. A debarking tooth as claimed in claim 2, wherein a taper angle of said at least one engagement projection is set greater than a taper angle of said at least one engagement recess.

11. A debarking tooth as claimed in claim 3, wherein a taper angle of said at least one engagement projection is set greater than a taper angle of said at least one engagement recess.

12. A debarking tooth as claimed in claim 4, wherein a taper angle of said at least one engagement projection is set greater than a taper angle of said at least one engagement recess.

13. A debarking tooth as claimed in claim 5, wherein a taper angle of said at least one engagement projection is set greater than a taper angle of said at least one engagement recess.

14. A debarking tooth as claimed in claim 2, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

15. A debarking tooth as claimed in claim 3, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

16. A debarking tooth as claimed in claim 4, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

17. A debarking tooth as claimed in claim 5, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

18. A debarking tooth as claimed in claim 6, wherein a foreign-matter penetration preventing engagement recess is formed in said at least one engagement projection and a foreign-matter penetration preventing engagement projection is formed on said at least one engagement recess, said foreign-matter penetration preventing engagement projection being engageable with said foreign-matter penetration preventing recess.

19. A debarking tooth as claimed in claim 2, wherein said platform includes an engagement section positioned on a first end of said platform in a rotational direction of said rotary member so that an end of said blade tip plate engages said engagement section when said blade tip plate is attached to said platform.

20. A debarking tooth as claimed in claim 6, wherein said platform includes an engagement section positioned on a first end of said platform in a rotational direction of said rotary member so that an end of said blade tip plate engages said engagement section when said blade tip plate is attached to said platform.

* * * * *